US011576479B2

(12) United States Patent
Mozafari

(10) Patent No.: US 11,576,479 B2
(45) Date of Patent: Feb. 14, 2023

(54) GARMENTS WITH INTEGRATED REMOVABLE WAISTPACK

(71) Applicant: The North Face Apparel Corp., Wilmington, DE (US)

(72) Inventor: Niloufar Mozafari, Los Angeles, CA (US)

(73) Assignee: The North Face Apparel Corp., Wilmington, DE (US)

( * ) Notice: Subject to any disclaimer, the term of this patent is extended or adjusted under 35 U.S.C. 154(b) by 352 days.

(21) Appl. No.: 16/748,173

(22) Filed: Jan. 21, 2020

(65) Prior Publication Data

US 2021/0219701 A1 Jul. 22, 2021

Related U.S. Application Data

(63) Continuation-in-part of application No. 29/721,177, filed on Jan. 17, 2020.

(51) Int. Cl.
*A45F 3/00* (2006.01)
*A41F 9/02* (2006.01)

(52) U.S. Cl.
CPC ..... *A45F 3/005* (2013.01); *A41F 9/02* (2013.01); *A45F 2003/003* (2013.01)

(58) Field of Classification Search
CPC ..... A45F 3/005; A45F 2003/003; A41F 9/02
See application file for complete search history.

(56) References Cited

U.S. PATENT DOCUMENTS 297,268 A 4/1884 Kepley
1,196,324 A * 8/1916 Atkins ..... A41D 1/14 2/211
1,776,614 A * 9/1930 Bauer ..... A41F 9/025 D11/208

(Continued)

FOREIGN PATENT DOCUMENTS

CN 203087561 7/2013
CN 206137263 5/2017

(Continued)

OTHER PUBLICATIONS

International Search Report and Written Opinion for PCT Application No. PCT/US2020/038844, dated Oct. 5, 2020, 9 pages.

(Continued)

*Primary Examiner* — Brian D Nash
(74) *Attorney, Agent, or Firm* — Smith, Gambrell & Russell LLP

(57) ABSTRACT

A garment's pelvic region includes an integrated, removable waistpack. The waistpack has a body portion disposed substantially between a first pair of opposing openings each leading into a respective elongate channel disposed along opposite sides of a waistband area of the pelvic region. The removable waistpack's body portion defines a compartment. Belt portions extend from opposing ends of the body portion through a respective opening in the first pair of opposing openings and through a respective channel and out a respective one of a second pair of opposing openings for the channels. Thereby the waistpack encircles the waistband region of the garment. The belt portions disposed in the channels are removably received in and concealed by the channels.

21 Claims, 4 Drawing Sheets

(56) References Cited

U.S. PATENT DOCUMENTS

| | | | | |
|---|---|---|---|---|
| 2,004,477 | A | 6/1935 | Mather | |
| 2,197,584 | A * | 4/1940 | Latter | A41F 9/02 2/237 |
| 3,042,932 | A * | 7/1962 | Eppy | A41F 9/00 2/258 |
| 4,029,243 | A * | 6/1977 | Zerobnick | A45F 3/00 224/664 |
| 4,244,499 | A * | 1/1981 | Adams | A45C 1/04 224/676 |
| 5,050,244 | A * | 9/1991 | Kleinman | A41D 13/065 2/81 |
| 5,150,824 | A * | 9/1992 | Alvarez | A45F 3/02 D3/226 |
| D333,570 | S | 3/1993 | Murray | |
| D334,471 | S | 4/1993 | Yerby et al. | |
| 5,431,316 | A * | 7/1995 | Garcia | B60R 22/00 224/264 |
| D371,905 | S | 7/1996 | Kopel | |
| D374,983 | S | 10/1996 | Brucki | |
| 5,561,865 | A * | 10/1996 | Fjelstul | A41D 1/06 2/247 |
| D383,889 | S | 9/1997 | Gallegos | |
| 5,669,884 | A | 9/1997 | Bennes et al. | |
| 5,836,671 | A | 11/1998 | Chien | |
| 5,871,132 | A * | 2/1999 | Hargreaves | A41D 13/0537 224/675 |
| D408,628 | S | 4/1999 | Fusco | |
| D426,058 | S | 6/2000 | Gaines et al. | |
| D458,021 | S | 6/2002 | Willows et al. | |
| 6,698,636 | B2 * | 3/2004 | Angus | A45F 3/12 224/660 |
| D613,500 | S | 4/2010 | Overton | |
| D613,501 | S | 4/2010 | Overton | |
| D618,907 | S | 7/2010 | Overton | |
| D641,539 | S | 7/2011 | Zarabi | |
| D653,028 | S | 1/2012 | Willows et al. | |
| 8,104,654 | B2 | 1/2012 | Overton | |
| D683,521 | S | 6/2013 | Garcia | |
| 9,021,615 | B2 | 5/2015 | Cockram | |
| D731,753 | S | 6/2015 | Mahtani | |
| D737,049 | S | 8/2015 | Seip et al. | |
| 9,125,440 | B1 * | 9/2015 | Guerrero | A41D 1/06 |
| 9,295,289 | B2 | 3/2016 | James | |
| D793,665 | S | 8/2017 | Perez | |
| D802,915 | S | 11/2017 | Willows et al. | |
| D812,348 | S | 3/2018 | McManus et al. | |
| D816,303 | S | 5/2018 | Diakonov | |
| 9,961,947 | B2 | 5/2018 | Cockram | |
| D827,252 | S | 9/2018 | Salamat | |
| D831,341 | S | 10/2018 | Pomerantz | |
| D835,402 | S | 12/2018 | Pomerantz | |
| D839,591 | S | 2/2019 | Yamanaka | |
| 10,194,704 | B2 | 2/2019 | Nygard | |
| D842,585 | S | 3/2019 | Do | |
| D857,339 | S | 8/2019 | Holmes | |
| 10,398,183 | B2 * | 9/2019 | Berns | A41D 27/205 |
| 10,542,816 | B1 | 1/2020 | Newton | |
| D882,248 | S | 4/2020 | Dumas | |
| D883,661 | S | 5/2020 | Olsen et al. | |
| D886,414 | S | 6/2020 | Landry | |
| D893,134 | S | 8/2020 | Long | |
| D907,332 | S | 1/2021 | Liu | |
| D909,010 | S | 2/2021 | Long | |
| 10,973,270 | B2 | 4/2021 | Marshall | |
| D928,506 | S | 8/2021 | Sandoval | |
| 2002/0134809 | A1 * | 9/2002 | Angus | A45F 3/12 224/660 |
| 2005/0261113 | A1 | 11/2005 | Wilkinson | |
| 2006/0218690 | A1 * | 10/2006 | James | A45C 1/00 2/69 |
| 2007/0261150 | A1 * | 11/2007 | Oomae | A41F 9/02 2/221 |
| 2008/0190980 | A1 | 8/2008 | Overton | |
| 2009/0205096 | A1 | 8/2009 | Seemann | |
| 2009/0241235 | A1 * | 10/2009 | Weinreb | A45F 4/12 2/87 |
| 2015/0007379 | A1 * | 1/2015 | Cockram | A41D 13/0015 2/236 |
| 2017/0055680 | A1 * | 3/2017 | Donato, Jr. | A45F 5/021 |
| 2019/0335833 | A1 | 11/2019 | Kelley | |
| 2019/0350274 | A1 | 11/2019 | Winget | |
| 2020/0187573 | A1 | 6/2020 | Junod | |
| 2020/0245704 | A1 | 8/2020 | Hogberg | |
| 2020/0352267 | A1 | 11/2020 | Lazic | |
| 2021/0022423 | A1 | 1/2021 | Cox et al. | |
| 2021/0219701 | A1 | 7/2021 | Mozafari | |
| 2021/0235780 | A1 | 8/2021 | Prinzing | |

FOREIGN PATENT DOCUMENTS

| | | | |
|---|---|---|---|
| CN | 305133705 | S | 4/2019 |
| CN | 306427565 | S | 4/2021 |
| EM | 003825405-0006 | | 4/2017 |
| EM | 008039564-0001 | | 8/2020 |
| JP | 2010100978 | | 5/2010 |
| JP | 1678626 | S | 2/2021 |
| KR | 30-0961048 | | 6/2018 |
| KR | 30-1082-1880000 | | 11/2020 |

OTHER PUBLICATIONS

Black Leggings w/ Neon Fanny Pack. Published: Oct. 2, 2018 [visited: Oct. 4, 2021] URL https://sportvivos.com/female-activewear/black-leggings-w-neon-fanny-pack/ (Year: 2018).

Ibeauti Yoga Pants. First available: Aug. 7, 2019 [visited: Oct. 4, 2021] URL https://www.amazon.com/Ibeauti-Running-Pockets-Leggings-Workout/dp/B07W6P4J9G (Year: 2019).

Level Terrain Flipbelt Crops, first available: Apr. 6, 2021 [visited: Oct. 4, 2021] URL https://www.amazon.com/Level-Terrain-Crops-Waist-X-Large/dp/B076FFX2BB7ref=ast_sto_dp&th=1&psc=1 (Year: 2021).

The North Face Active Trail High Rise Waist Pack Tight. Oldest review: Feb. 2021 ("8 months ago") [visited Oct. 4, 2021] URL: https://www.dillards.eom/p/the-north-face-active-trail-high-rise-waist-pack-tight/512254276 (Year: 2021).

* cited by examiner

GARMENTS WITH INTEGRATED REMOVABLE WAISTPACK

RELATED APPLICATIONS

This application claims the benefit of and priority to U.S. Design application Ser. No. 29/721,177, filed on Jan. 17, 2020, which is hereby incorporated by reference in its entirety, for all purposes.

BACKGROUND

The inventive subject matter is generally directed to garments for the lower body, such as tights, shorts, pants and knickers. The inventive subject matter is particularly directed to elastic (stretch) tights that conform to body contours. The garments according to inventive subject matter have an integrated, removable waistpack system that provides a non-bulky, unobtrusive fit that aesthetically integrates with the pelvic region of the garment.

Prior art garments are known to have belts which fit through conventional belt loops. In some cases, the belts have included storage compartments that are defined within the dimensions of the belt. Unfortunately, integration of such compartments into belts leaves only minimal storage space and are suitable only for compact items like paper currency, credit cards, or a few keys. Modern consumers need adequate storage space for bulkier items like mobile phones and other such devices, headphones, snacks, hydration bladders, etc., as well as the traditional currency, cards and keys.

While waistpacks (also known as "fanny packs") for belting around the waist have larger compartments and are well known, they typically suffer from a bulky fit and appearance. They are not designed to integrate with a garment in an ergonomic and efficient way. Nor are they intended to provide a supplemental way of tightening the fit of the waistband of a garment, although their belt sections might happen to fit though belt loops. In any case, conventional waistpacks are not suitable for use with modern elastic tights.

Elastic tights are typically made from a stretch fabric with yarns or threads that include elastane fibers. They typically have a thickness defined by a single ply of fabric. One or more panels of the fabric define the body-covering area of the tights, and multiple panels may be connected by joining of panel edges to form a continuous single ply defining the body-covering area. Accordingly, the tights have a lightweight and stretchy nature. The elastic panels defining the garment also typically have a smooth, low friction surface. They are also typically free of belt loops, which are not conducive to comfort or appearance in applications for which tights are intended, e.g., yoga, dance, running, etc. Conventional waistpacks are not well received on tights because of their relatively slippery surface. They can slide up and down or lateral, disrupting activities and annoying the user.

Accordingly, a substantial need exists for improved garment/waistpack systems that provide a secure and comfortable fit, have adequate storage space, and have good aesthetics.

SUMMARY

The inventive subject matter addresses the foregoing and other needs. The following embodiments are representative of how the inventive subject matter can address such needs.

A garment's pelvic region includes an integrated, removable waistpack. The waistpack has a body portion disposed substantially between a first pair of opposing openings each leading into a respective elongate channel disposed along opposite sides of a waistband area of the pelvic region. The removable waistpack's body portion defines a compartment. Belt portions extend from opposing ends of the body portion through a respective opening in the first pair of opposing openings and through a respective channel and out a respective one of a second pair of opposing openings for the channels. Thereby the waistpack encircles the waistband region of the garment. The belt portions disposed in the channels are removably received in and concealed by the channels.

In certain embodiments, the inventive subject matter is directed to a garment that includes a pelvic region with a waistband region having an integrated, removable waistpack body portion disposed substantially between a first pair of opposing openings, each opening leading into a respective elongate channel disposed along opposite sides of a waistband area of the pelvic region. The removable waistpack's body portion defining a compartment and belt portions. The belt portions each extend from opposing ends of the body portion through a respective opening in the first pair of opposing openings, through a respective channel, and out a respective one of a second pair of opposing openings for the channels. Thereby, the waistpack encircles the waistband region of the garment. The belt portions disposed in the channels are removably received in and concealed by the channels.

In the foregoing and other embodiments, at least an end portion of the opposing sides of the body portion may be removably received in the channels.

In the foregoing and other embodiments, the end portions may downwardly taper from the body portion.

In the foregoing and other embodiments, the waistpack may be disposed on the rear pelvic region and the channels are disposed along lateral sides of the pelvic region, the first pair of openings defining the area of the rear pelvic region in between which the body portion of the waistpack is disposed.

In the foregoing and other embodiments, the rear pelvic region of the garment may be a substantially an elastic fabric.

In the foregoing and other embodiments, the garment may include leg regions that are configured as pants that have lower edges that are disposed below the knees of the intended user.

In the foregoing and other embodiments, the garment may include leg regions that are configured as shorts that have lower edges that are disposed above the knees of the intended user.

In the foregoing and other embodiments, both the pelvic region and the body portion of the waistpack may include a panel of a single ply of fabric that is at least 5% elastic fibers.

In the foregoing and other embodiments, the pelvic region and the body portion may be the same kind of fabric.

In the foregoing and other embodiments, at least the area of the pelvic region below a waistband may be a single ply of the fabric and the body portion defining the compartment may be a single ply of the fabric.

In the foregoing and other embodiments, the pelvic region may be a single ply of the fabric and the body portion defining the compartment may be a single ply of the fabric.

In the foregoing and other embodiments, at least the area of the pelvic region below a waistband region may be a single ply of the fabric and the body portion defining the compartment is a single ply of the fabric.

In the foregoing and other embodiments, at least an area of the pelvic region over which the waistpack is disposed may be the same material, construction and/or color pattern as is included in the body of the waistpack so as to provide functional and/or aesthetic integration.

In the foregoing and other embodiments, the pelvic region over which the waistpack is disposed may be the same material as is included in the body of the waistpack so as to provide functional and/or aesthetic integration.

In the foregoing and other embodiments, the pelvic region may have one or more panels of 2-way stretch elastic fabric that selectively stretches in the horizontal direction.

In the foregoing and other embodiments, the pelvic region may have one or more panels of 4-way stretch elastic fabric that selectively stretches in the horizontal direction and vertical directions.

In the foregoing and other embodiments, the waistpack may expandably collapse to a flat form when the compartment is empty.

In the foregoing and other embodiment, the waistpack may expandably collapse to a flat planar form when the compartment is empty thereby providing a flush finish with the garment.

In a possible embodiment, the inventive subject matter is directed to a pair of stretch tights that include a resiliently stretchable pelvic region having a waistband region. The front and/or the rear portions of the pelvic region include an integrated, removable waistpack body portion disposed substantially between a first pair of opposing openings, each opening leading into a respective elongate channel disposed along opposite sides of a waistband area of the pelvic region. The removable waistpack's body portion defines a compartment and belt portions. The belt portions each extend from opposing ends of the body portion through a respective opening in the first pair of opposing openings, through a respective channel, and out a respective one of a second pair of opposing openings for the channels. Thereby, the waistpack encircles the waistband region of the garment. The belt portions disposed in the channels are removably received in and concealed by the channels along at least the lateral sides of the pelvic region.

In a possible embodiment, the inventive subject matter is directed to a method of forming a garment with a removable waistpack that includes the steps of: providing a pelvic region including a waistband region; and providing at the front and/or the rear portions of the pelvic region an integrated, removable waistpack body portion disposed substantially between a first pair of opposing openings for respective elongate channels disposed along a waistband area of the pelvic region. The removable waistpack's body portion defines a compartment. The waistpack has belt portions each extending from opposing ends of the body portion through respective ones of the first pair of opposing openings, through the respective channels, and out a second pair of opposing openings for the channels. Thereby, the waistpack encircles the waistband region of the garment. The belt portions disposed in the channels are removably received in and concealed by the channels.

BRIEF DESCRIPTION OF THE DRAWINGS

The following figures, FIGS. 1-7, show one possible embodiment according to the inventive subject matter, unless noted as showing prior art. The figures presented are for illustrative and explanatory purposes and are not necessary in scale.

FIG. 1 shows a back view of a garment, in this case tights with an integrated removable waistpack.

FIG. 2 shows a front view of the garment of FIG. 1.

FIG. 3 shows a left-side view of the garment of FIG. 1 (the right-side view being a mirror image).

FIG. 4 shows a front view of the removable pack isolated from the garment.

FIG. 6 is an enlarged view of the waist area of the garment seen in FIG. 1.

FIG. 7 is an enlarged view of the waist area of the garment seen in FIG. 2.

DETAILED DESCRIPTION

Figure 3:
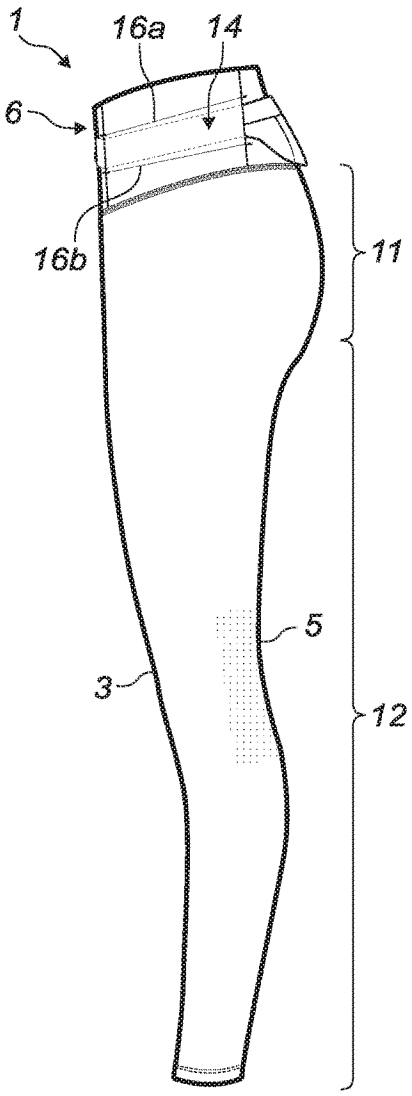
Figure 2:
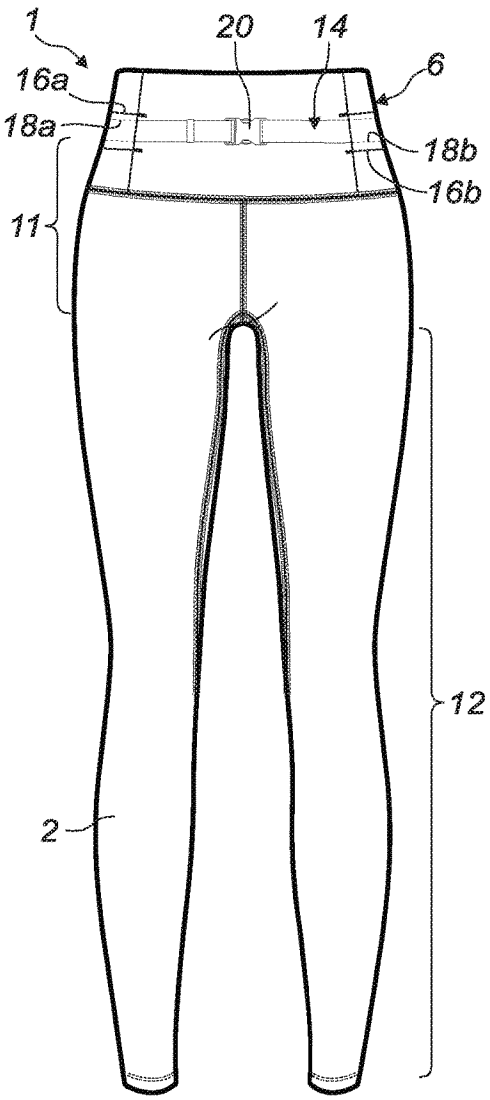

Representative embodiments according to the inventive subject matter are shown in FIGS. 1-7 or described herein, wherein the same or generally similar features sharing common reference numerals.

The inventive subject matter is generally directed to a garment, for example, stretch tights, that includes pelvic and leg regions. A waistpack included at the top of the pelvic region has a body portion that includes a storage compartment. A belt portion for encircling the user's waist extends from opposing sides of the body portion.

The waistpack may integrate with channels formed in the pelvic region of the garment so that the waistpack securely and adjustably attaches to the pelvic region of the garment. The channels also hide the waist pack's belt portion so that it is fully or partially hidden and does not detract from the aesthetics of the garment. Ends portions of the waistpack's body portion may also be disposed into the channels to provide a more integrated connection and/or look. In some embodiments, the waistpack (at least in an empty state) integrates to provide a flush finish with the adjacent portion of the garment.

As used herein, a "flush finish" means that the selected area is free of conspicuous bulges and protrusions; it is visually, substantially level, i.e., having at least an outer surface that is nearly coplanar with the surrounding area of material to which it is disposed over when the materials are laid flat. By forming the waistpack with the same or similar materials as the garment; single or thin plies of material; and/or geometrically shaping the waistpack to contours of the garment and anatomy, a flush finish may be achievable.

The following description and accompanying figures disclose a garment 1 having a representative configuration of a pair of stretch tights that substantially conform to, or follow the body contours of, an intended user.

In other configurations, garment 1 may be knickers, shorts, or any other kind of garment that includes a pants portion, e.g., a jumpsuit, or even a skirt or other dress. In other words, the garment may be any garment with a waistband area for supporting a waistpack. Accordingly, the concepts associated with garment 1 may be applied to a wide range of garment styles or configurations that are used for both athletic and non-athletic activities.

Garment 1 generally includes a pelvic region 11 and a pair of leg regions 12. Pelvic region 11 has a configuration that substantially extends around and covers a pelvic area of an individual. As commonly known, there is an anterior or front pelvic region and a posterior or back pelvic region. Leg regions 12 extend downward from opposite sides of pelvic region 11 and have a configuration that substantially extends around and covers upper leg areas of individual. Garment 1 may also be defined by multiple zones or panel portions, e.g., panel portions 2, 3, 4, 6, across the front and rear portions of the garment, as discussed in more detail below Garment 1 has a main body, which generally defines each of regions 11 and 12, that may be formed from one or more textile elements. If the body is formed of multiple elements, the elements may be joined through, for example, stitching, adhesives, bonding, and/or thermobonding. Some or all the body of garment 1 may be a unitary, seamless construction based on known weaving and knitting techniques for producing three-dimensional configurations. In certain embodiments, the body of garment 1 is formed of one or more panels of drapable material that extend coplanarly around the parts of the body they surround. For example, multiple panels can be joined edge-to-edge to create a coplanar outer surface construction across multiple body regions, e.g., the front and rear pelvic regions. In other embodiments, a single sheet or ply of drapable material surrounds such multiple body regions in a seamless construction. Any given panel can be made of single ply of material or multiple plies that are laminated together, e.g., a laminate of a durable outer material and an inner comfort liner. In other cases, a ply in the laminate could be a waterproof/breathable layer like a membrane of ePTFE.

The textile elements used to form any portion of garment 1 may be formed from any combination of 2-way or 4-way stretch textiles or non-stretch textiles. The 2-way stretch textiles may be configured into the garment to provide horizontal or vertical preferential directions of stretch. The 4-way stretch textiles may provide both vertical and horizontal directions of stretch. In addition to stretch materials that are made with elastic fibers, stretch may also be provided by fabrics constructed with inelastic fibers but formed in manner that provides mechanical stretch. For example, various known knit constructions can provide elastic stretch.

Although non-stretch textile elements may be used exclusively in garment 10, an advantage to stretch textile elements is that portions of regions 11 and 12 will selectively, resiliently stretch or otherwise elongate to conform with movements of the user during activities, thereby providing less restriction and a greater freedom of movement during the activities. The textile elements may also be formed from either woven or knitted textiles. Although knitted textile elements may be utilized in garment 1, an advantage of woven textile elements relates to high durability and a low tendency to permanently deform when subjected to tensile forces (i.e., when stretched). In some configurations, portions of garment 1 may also include various appliqués, transfers, patches, indicia, tags, pulls, grommets, or other aesthetic or functional features. The garment may optionally include one or more pockets, which may have a body that overlaps the body of the garment or is formed behind the body, with just a slot on the body surface for accessing the pocket. (The latter approach would leave the garment with a flush finish in the pocket area.)

Pelvic region 11 includes a waistband system 14 that defines an upper opening out of which a torso area of a user extends.

Figure 1:
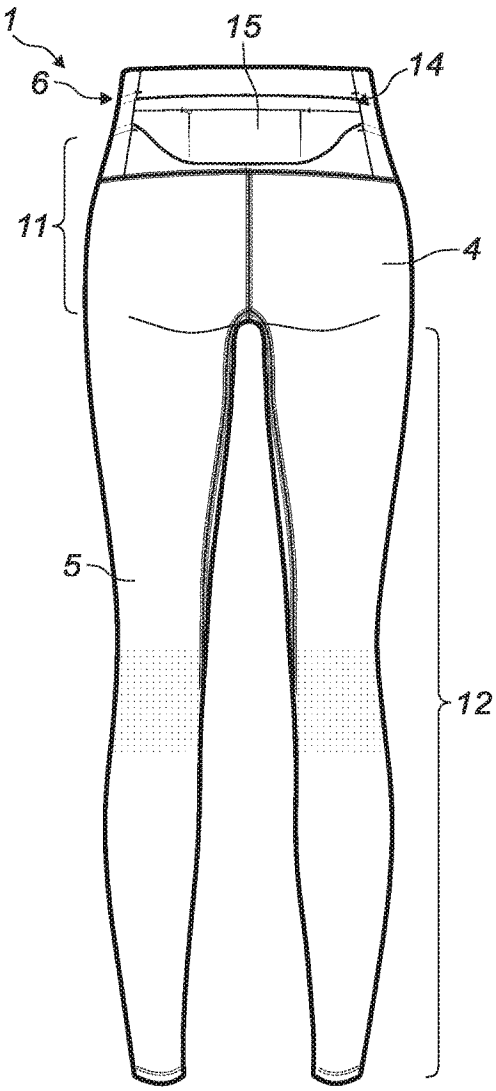
Figure 4:
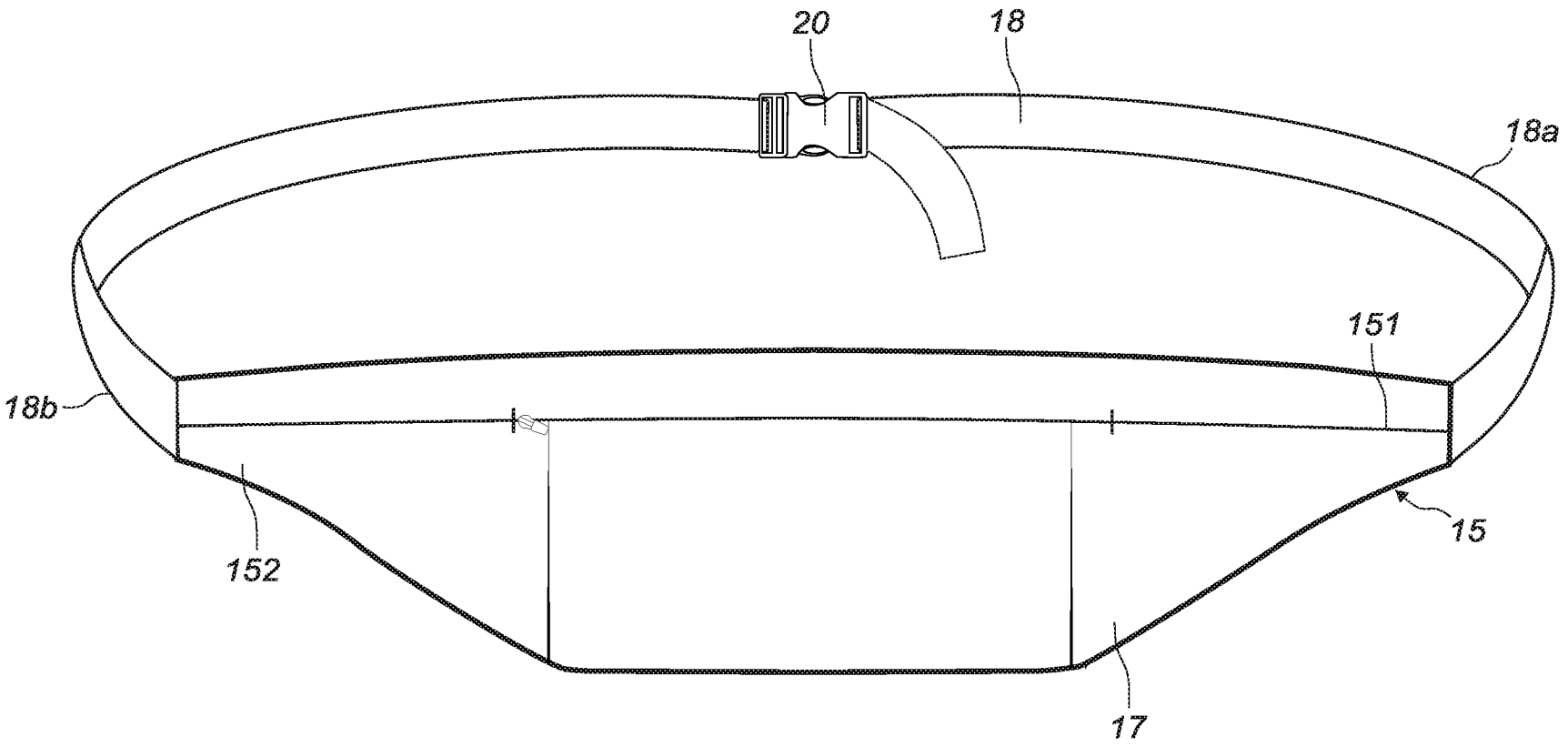
Figures 5A, 5B, 5C:
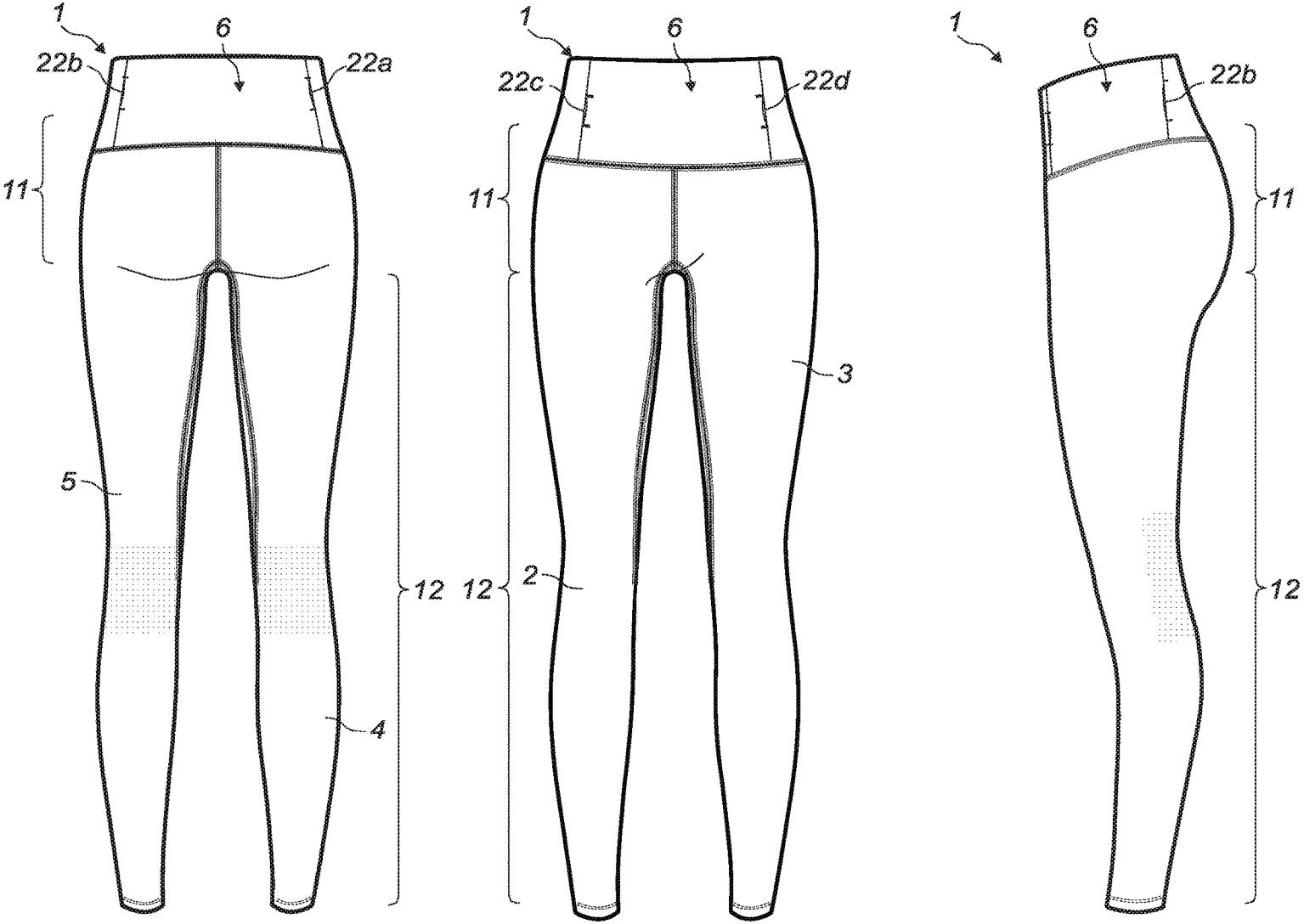
FIG. 5A is the garment of FIG. 1 with the waistpack removed.
FIG. 5B is the garment of FIG. 2 with the waistpack removed.
FIG. 5C is the garment of FIG. 3 with the waistpack removed.
Figure 6:
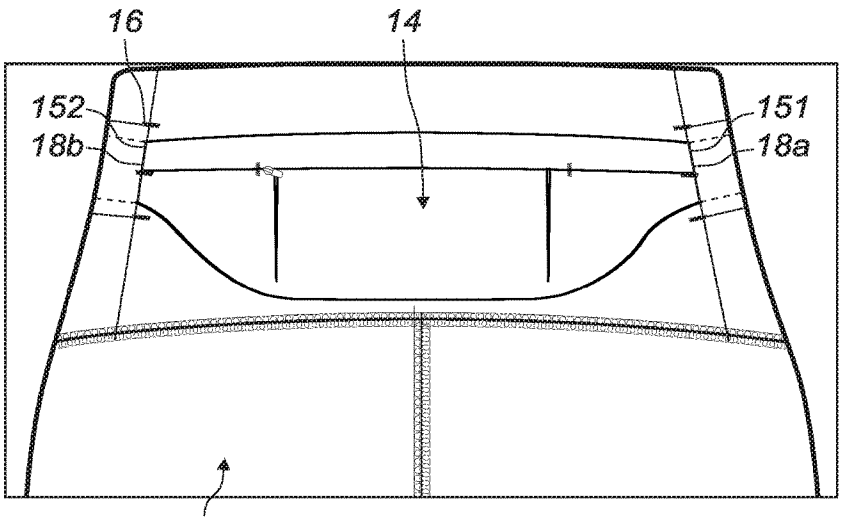
Figure 7:
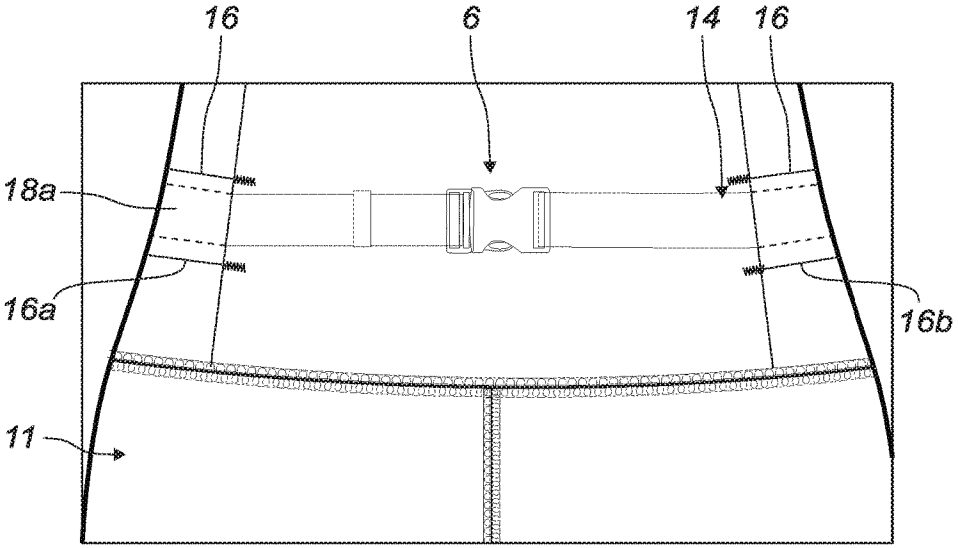

FIG. 1 shows a front view of a pair of an exemplary garment, namely a pair of tights 1. The tights include a front pelvic region, which optionally have a flush finish. In this example, the front region has a waistband portion that extends across the front pelvic region. The front pelvic region includes a right front panel portion 2, a left front panel portion 3, a right rear panel portion 4, a left rear panel portion 5, and a waist area panel portion 6 configured to be disposed substantially over the waist area of the intended user. At least the front waistband and the front panels are joined together with seams in a flush finish. The left and right front panel portions are adjacent to each other and disposed over the front of pelvic region 11. The front pelvic region is free of zippers, laces, gussets, buttons or other fly or waist closures that bulge and cause a non-flush surface with the general, front pelvic region (not counting any pockets that may be provided at the sides of the pelvic region). Although not shown, in other embodiments, the panel portions and waistband zone may be joined in a unitary, seamless construction. Consistent with a flyless embodiment, the waistband panel or zone may be a continuous, uninterrupted structure that does not disengage or separate from itself, as would be the case with a conventional waistband having waistband closure structure associated with a fly structure.

The tights 1 or other kind of garment may be constructed from any number of known textile materials. Example materials include fabrics based on fibers of elastane, trixeta (e.g., Sorona brand fibers by DuPont), polyester, nylon, or fabrics having blends of such fibers, or lightweight neoprene. The tights or other kind of garment may be made in whole or part of elastic or inelastic material, with placement of selected materials in various arrangements. For example, tights or other kinds of garments may be made with varying zones of elastic and inelastic materials. For example. Front, rear, waist and/or side zones may be made of an elastic fabric, such as a fabric having elastane or trixeta fibers, or elastic fiber blends. Suitable blends may have at least 2%, 5%, 7%, 10%, 15%, 20%, 25%, 30%, 35%, 40%, 50%, or thereabout any such value, elastic fibers. The remainder may be natural and/or synthetic fabric such as polyester, nylon, cotton, or wool. In certain embodiments, the blend has 5%-20% elastic fibers, of thereabout such range. In one suitable embodiment, one or more of panels may consist of a fabric blend that is 90% polyester fibers/10% elastic fibers, or thereabout such values). And one or more of the panels consist of a relatively inelastic material that may have at least 50% of polyester, nylon, cotton, or wool. In some embodiments, the garment includes one or more front panels and a waist panel that are inelastic and one or more rear panels that are inelastic. The elastic panels may be knit or woven 2-way or 4-way stretch materials, as noted earlier. The foregoing description is not intended to be limiting. For example, in other embodiments, all panels may be elastic, or all panels may be inelastic. As used herein, elasticity and inelasticity are relative terms that mean there is or is not appreciable stretch during expected conditions of use as active bodywear.

The integrated waistpack 15, includes a body portion 17 that defines a storage compartment (not shown) for storing items. A belt portion 18 is coupled to the waistpack and extends from opposing ends of the body portion. The body portion defines a volumetric space (the storage compartment) into which the items can be placed and held securely. The volumetric space may expandably collapse into a flat form of parallel adjacent plies or sheets of material when the compartment is empty. When items are placed in the compartment, the sheets separate forming a volumetric space.

Typically, the compartment is fully enclosed by the material of the body portion but is accessible through a closable opening. For example, the body portion may have zippers, hook and loop fasteners, buttons, magnets, and other means formed in or on a panel of body portion material. Access to the compartment may be by separating adjacent sections or panels of material, e.g., by unzipping joined section. Or it might be by separating overlapping sections that are sealed using complementary hook-and-loop fasteners, e.g., lifting a flap of material.

The body portion may have multiple compartments or sub-compartments. In general, body portion provides a substantially larger compartment for storage than could be defined in a belt portion of the same length as body portion. In some embodiments for example, the body portion will have a maximum width that is 1.25, 1.5, 1.75, 2, 3, 4, 5, 9, 10, (or thereabout any such dimension) times the maximum width of the belt portion. In some embodiments, the belt portion's maximum width is not more than 5 cm and the waistpack's body portion is at least 10 cm. In some embodiments, the waistpack is configured to conform to the small of the intended user's back, and it may extend wholly or partially just below or above it.

In the Figures, end portions 151, 152 taper from a generally rectangular central portion. Further, the compartment need not fully enclose stored items. It may be a mesh or have other open areas so long as it sufficiently contains items during conditions of intended use.

The waistpack 15 may be formed from any number of textile or other sheet materials. It may be formed using the same or similar techniques, materials and arrangements described elsewhere herein for the main body-covering garment. To provide for an integrated fit, the waistpack may be formed of the same materials and/or construction type as the portion of the garment over which it is disposed. For example, in the case of tights, the tights would typically be made of one or more panels of a single ply of material, typically a stretch material. The waistpack could be formed of the same material. It could be formed or assembled in the same or similar way, e.g., same or similar weaves or knits or same or similar stitch lines and patterns. It could have similar colors or color patterns. Any one or more of these things could provide for integration with the look and/or performance of the main garment. For example, by using the same or similar stretch materials, the stretchability of the waistpack can match or substantially match that of the garment or at least the area of the garment over which the waistpack is disposed. By using similar colors or color patterns, the waistpack can integrate by blending in. By sizing and shaping the waistpack to conform to user anatomy, the waistpack integrates by following how the garment conforms to the body and not being unobtrusive. By hiding belt portions, and optionally at least some body portions of the waistpack in a housing in the garment, the waistpack integrates by being less visible, as well as better secured. By forming the waistpack of single ply of thin material, such as a stretch fabric, the waistpack integrates by having essentially a flush finish with an adjacent garment panel portion of stretch fabric over which the waistpack is disposed. In other words, such an arrangement provides a flat fit of the waistpack (at least when empty) without conspicuous bulk.

The Figures show a waistpack 15 integrated into the garment 1 so as to be disposed at the rear of the user's pelvic region. In other embodiments, the waistpack could be integrated into the garment so as to be disposed at the front of the pelvic region. In yet other embodiments, it could be integrated into the garment so as to be disposed at a lateral side of the pelvic region. The garment could also be configured to integrate with multiple waistpacks over any two or more such regions. The integration of a waistpack with the waistband area of a garment is discussed in more detail below.

Tights or other garments 1 may include a waistband system 14 that encircles the user and is integral with the front and back of pelvic region 10 disposed below the waistband system. The waistband system consists of two principal components: (i) a housing or channel 16 and (ii) waistpack belt portion 18 (formed of separate portions 18*a*, 18*b*) that are removably and adjustable disposed in the housing. The ends of the belt portions may include a lock 20 having separable engageable portions that operatively engage/disengage the belt portions to secure the waistpack around the user's waist. The lock may allow for slidable adjustment of the belt portions to lock the waist pack in a desired state of tension.

Housing 16 is a generally tubular configuration of textile or other flexible material, thereby the housing consists of one or more channels on the pelvic region that receive the waistpack's belt portions, and in some embodiments, one or more portions of the waistpack, as well. For example, the housing can be formed by folding an elongate piece of fabric over itself so that edges align and joining the edges and terminal ends via stitching or other joining technique noted earlier. In other embodiments, the housing 16 may be formed of two separate elongate pieces of fabric that have edges aligned and are joined along the aligned edges and their terminal ends. In other embodiments, housing 16 is unitary, tubular structure that is seamlessly woven or knitted. In any case, housing 16 may in turn be joined to the body of garment 1 to form an upper perimetrical portion of pelvic region 11. In the embodiment shown, but not necessarily in all embodiments, housing 16 encircles the pelvic region with a break that would allow portions of the waistband to disengage, or it may have a break that allows portions of the waistband to disengage, opening the waistband. In some embodiments, the housing provides elongate channels 16*a*, 16*b* on at least lateral sides of the pelvic regions for receiving the elements of the waistpack.

As seen in the example embodiment of the Figures, the channels 22 (individually 22*a*, 22*b*, 22*c*, 22*d*) are disposed only on the lateral sides of the pelvic region. The belt portions enter channel openings 22*a*, 22*b* at rear portions of the lateral side channels and exit channel openings 22*c*, 22*d* at front portions of the lateral side channels. The belt portions are therefore exposed on the front pelvic region. In the back pelvic region 11, the body portion of the waistpack sits in the void between the rear channel openings. The belt portions are not visible. Therefore, the waistpack appears to integrate with the pants functionally and/or visually. The body of the waist pack also has opposing end portions 151, 152 that taper downwardly. Some of the tapered portion may conformingly fit into the openings and into the channels to further integrate the waistpack into the pelvic region.

Belt portion 18 is an elongate, tensionable structure that is disposed in housing 16, except for one or more extendable portions that extend from one or more slots or other openings 22 formed in the housing. An extendable portion may extend through an opening so that it can be associated with a user-operable lock 20. A user can interact with the belt portions to set the waistband system in a desired state of adjustment and tension. The belt portions may be, for example, a band, web or bundle of flexible material. The belt portions may include a plurality of segments that are coupled together in end-to-end fashion. The belt portions, and portions thereof, may be made of woven or knitted webbing, leather strapping, a bundle of straps, cords, or cables, etc. Such structures can be made of any natural or synthetic materials or combinations thereof. The belt portions advantageously may be a combination of inelastic and elastic sections. By using a combination of material, the belt 18 provides a secure, comfortable fit around the user. A combination of inelastic and elastic materials may be used to provide a secure fit while allowing for some give and take during use.

When the lock 20 or other coupling means for the belt portions are disengaged, the belt portions may be slidably withdrawn from housing 18 by pulling on the waistpack. Lock 20 may be a cam buckle that consists of a pair of slots, through which a slidable portion of the belt portions can be routed, along with a cam portion. Although note shown, as is well known, cam locks may include portion includes a latch and a cam head. The cam head is rotatable and selectively engages the belt portion between the head and a cross member. The latch extends from the head for the user to grasp and rotate the cam head between locked and unlocked positions. The foregoing is one possible version of a cam buckle, and, as persons skilled in the art will appreciate, other versions are known and possible. In addition to cam buckles, lock 20 can be any number of other buckles, clamps, or other locking systems for slidably engaging straps and the like, and selectively locking or unlocking the strap.

Persons skilled in the art will appreciate that the foregoing principles may be reflected in a variety of other embodiments. For example, the waistband system may have multiple segments and arrangements of elastic and inelastic materials, and it may have multiple openings, to allow for multiple adjustment points that are disposed of and away from the front of the garment. For instance, there could be a second adjustment opening with an associated adjustable portion of a belt portion and lock disposed on the opposite of side of the user's body, behind the left hip.

The waist area panel portion 6 or zone may fully or partially encircle the user. It may also rise above the waist line to the lower belly area of an intended user. It, and any other panel or zone, may have the same or different material properties as adjacent zones. The waist panel or zone may connect to the quarter panels by generally horizontal seams. As persons skilled in the art will appreciate, the foregoing is just one of many possible embodiments of the inventive subject matter, and it is not intended to limit the scope of the inventive subject matter.

Terminology and Scope

Persons skilled in the art will recognize that many modifications and variations are possible in the details, materials, and arrangements of the parts and actions which have been described and illustrated to explain the nature of the inventive subject matter, and that such modifications and variations do not depart from the spirit and scope of the teachings and claims contained therein.

The principles described above about any particular example can be combined with the principles described in connection with any one or more of the other examples. Accordingly, this detailed description shall not be construed in a limiting sense, and following a review of this disclosure, those of ordinary skill in the art will appreciate the wide variety of systems that can be devised using the various concepts described herein. Moreover, those of ordinary skill in the art will appreciate that the exemplary embodiments disclosed herein can be adapted to various configurations without departing from the disclosed principles.

The previous description of the disclosed embodiments is provided to enable any person skilled in the art to make or use the disclosed innovations. Various modifications to those embodiments will be plain to those skilled in the art, and the generic principles defined herein may be applied to other embodiments without departing from the spirit or scope of this disclosure. Thus, the claimed inventions are not intended to be limited to the embodiments shown herein, but are to be accorded the full scope consistent with the language of the claims, wherein reference to an element in the singular, such as by use of the article "a" or "an" is not intended to mean "one and only one" unless specifically so stated, but rather "one or more".

If and as used herein the terms "part", "portion", "segment", "region," "zone," "section" and like terms are generally synonymous terms and do not imply that something is or is not a discrete element or subcomponent in a larger construct or is or is not a non-discrete subdivision of a larger unitary construct, unless context indicates otherwise.

All structural and functional equivalents to the elements of the various embodiments described throughout the disclosure that are known or later come to be known to those of ordinary skill in the art are intended to be encompassed by the features described and claimed herein. Moreover, nothing disclosed herein is intended to be dedicated to the public regardless of whether such disclosure is explicitly recited in the claims. No claim element is to be construed as "a means plus function" claim under US patent law, unless the element is expressly recited using the phrase "means for" or "step for".

Each named inventor and the applicant reserve all rights to the subject matter disclosed herein.

The invention claimed is:

1. A garment, comprising:

a pelvic region including a waistband region having a first pair of opposing openings each leading into a respective one of a pair of elongate channels disposed along opposite sides of the waistband region and a second pair of opposing openings for the elongate channels;

an integrated, removable waistpack body portion configured to be attached to the pelvic region via the elongate channels, the removable waistpack body portion defining a compartment and belt portions, the belt portions each extending from opposing ends of the body portion through a respective opening in the first pair of opposing openings, and through a respective channel and out a respective one of the second pair of opposing openings for the channels, thereby encircling the waistband region of the garment; and wherein the belt portions disposed in the channels are removably received in and concealed by the channels.

2. The garment of claim 1 wherein at least an end portion of the opposing sides of the body portion are removably received in the channels.

3. The garment of claim 1 wherein the end portions downwardly taper from the body portion.

4. The garment of claim 1 wherein the waistpack is disposed on the rear pelvic region and the channels are disposed along lateral sides of the pelvic region, the first pair of openings defining the area of the rear pelvic region in between which the body portion of the waistpack is disposed.

5. The garment of claim 4 wherein the rear pelvic region of the garment comprises substantially an elastic fabric.

6. The garment of claim 1 wherein the garment further comprises leg regions that are configured as pants that have lower edges that are disposed below the knees of the intended user.

7. The garment of claim 1 wherein the garment further comprises leg regions that are configured as shorts that have lower edges that are disposed above the knees of the intended user.

8. The garment of claim 1 wherein both the pelvic region and the body portion of the waistpack comprise a panel of a single ply of fabric comprising at least 5% elastic fibers.

9. The garment of claim 1 wherein the pelvic region and the body portion comprise the same kind of fabric.

10. The garment of claim 9 wherein the pelvic region comprises a single ply of the fabric and the body portion defining the compartment is a single ply of the fabric.

11. The garment of claim 10 wherein at least the area of the pelvic region below a waistband region comprises a single ply of the fabric and the body portion defining the compartment is a single ply of the fabric.

12. The garment of claim 11 wherein the pelvic region comprises one or more panels of 2-way stretch elastic fabric that selectively stretches in the horizontal direction.

13. The garment of claim 11 wherein the pelvic region comprises one or more panels of 4-way stretch elastic fabric that selectively stretches in the horizontal direction and vertical directions.

14. The garment of claim 11 wherein the waistpack expandably collapses to a flat form when the compartment is empty.

15. The garment of claim 1 wherein at least the area of the pelvic region below a waistband comprises a single ply of the fabric and the body portion defining the compartment is a single ply of the fabric.

16. The garment of claim 1 wherein at least area of the pelvic region over which the waistpack is disposed comprises the same material, construction and/or color pattern as included in the body portion of the waistpack so as to provide functional and/or aesthetic integration.

17. The garment of claim 16 wherein the pelvic region over which the waistpack is disposed comprises the same material as is included in the body of the waistpack so as to provide functional and/or aesthetic integration.

18. The garment of claim 16 wherein the waistpack expandably collapses to a flat planar form when the compartment is empty thereby providing a flush finish with the garment.

19. The garment of claim 1 wherein the waistpack expandably collapses to a flat form when the compartment is empty.

20. A pair of stretch tights, comprising:

a resiliently stretchable pelvic region including a waistband region, the front and the rear portions of the pelvic region including a first pair of opposing openings each leading into a respective one of a pair of elongate channels disposed along opposite sides of the waistband region and a second pair of opposing openings for the elongate channels;

an integrated, removable waistpack body portion configured to be attached to the pelvic region via the elongate channels, wherein the pelvic region comprises one or more panels of 2-way stretch elastic fabric that selectively stretches in the horizontal direction;

the removable waistpack body portion defining a compartment and belt portions, the belt portions each extending from opposing ends of the body portion through a respective opening of the first pair of opposing openings and through a respective channel and out a respective one of the second pair of opposing openings for the channels, thereby encircling the waistband region of the garment; and wherein the belt portions disposed in the channels are removably received in and concealed by the channels along at least the lateral sides of the pelvic region.

21. A method of forming a garment with a removable waistpack, comprising:

providing a pelvic region including a waistband region including a first pair of opposing openings each leading into a respective one of a pair of elongate channels disposed along opposite sides of the waistband region and a second pair of opposing openings for the elongate channels;

providing at the front and/or the rear portions of the pelvic region, an integrated, removable waistpack body portion configured to be attached to the pelvic region via the elongate channels, the removable waistpack body portion defining a compartment, and the waistpack having belt portions each extending from opposing ends of the body portion through a respective opening of the first pair of opposing openings, through the respective channels and out a respective one of the second pair of opposing openings for the channels, thereby encircling the waistband region of the garment; and wherein the belt portions disposed in the channels are removably received in and concealed by the channels.

* * * * *